US009347676B2

(12) United States Patent
Uselton

(10) Patent No.: US 9,347,676 B2
(45) Date of Patent: May 24, 2016

(54) ENHANCED DEHUMIDIFICATION CONTROL WITH VARIABLE CONDENSER REHEAT

(75) Inventor: Robert B. Uselton, Plano, TX (US)

(73) Assignee: Lennox Industries Inc., Richardson, TX (US)

( * ) Notice: Subject to any disclaimer, the term of this patent is extended or adjusted under 35 U.S.C. 154(b) by 2460 days.

(21) Appl. No.: 11/553,027

(22) Filed: Oct. 26, 2006

(65) Prior Publication Data

US 2008/0098756 A1 May 1, 2008

(51) Int. Cl.

| | |
|---|---|
| ***F25B 29/00*** | (2006.01) |
| ***F25B 17/04*** | (2006.01) |
| ***F25B 17/06*** | (2006.01) |
| ***F25B 49/00*** | (2006.01) |
| ***F24F 3/14*** | (2006.01) |
| ***F24F 11/00*** | (2006.01) |
| ***G05D 22/02*** | (2006.01) |
| ***F24F 3/153*** | (2006.01) |

(52) U.S. Cl.

CPC ..... *F24F 3/153* (2013.01); *F24F 11/0012* (2013.01); *F24F 11/0015* (2013.01)

(58) Field of Classification Search

CPC .... F24F 3/153; F24F 11/0012; F24F 11/0015
USPC ..... 62/93, 173, 176.1, 176.5; 236/44 A, 44 C
See application file for complete search history.

(56) References Cited

U.S. PATENT DOCUMENTS

| | | | | |
|---|---|---|---|---|
| 3,631,686 | A * | 1/1972 | Kautz | 62/173 |
| 4,984,433 | A | 1/1991 | Worthington | |
| 5,802,862 | A * | 9/1998 | Eiermann | 62/173 |
| 6,172,476 | B1 * | 1/2001 | Tolbert et al. | 62/228.4 |
| 6,427,454 | B1 * | 8/2002 | West | 62/93 |
| 6,427,461 | B1 | 8/2002 | Whinery et al. | |
| 6,694,756 | B1 | 2/2004 | Taras et al. | |
| 6,826,921 | B1 | 12/2004 | Uselton | |
| 2002/0092318 | A1 * | 7/2002 | Tipton et al. | 62/510 |
| 2005/0166618 | A1 * | 8/2005 | Bussjager | 62/196.4 |

* cited by examiner

*Primary Examiner* — M. Alexandra Elve
*Assistant Examiner* — Daniel C Comings
(74) *Attorney, Agent, or Firm* — Baker Botts L.L.P.

(57) ABSTRACT

An air conditioning system comprising an air mover for circulating air to a space; a vapor compression circuit including a compressor, a condenser, and an expansion device; an evaporator; an air-reheat heat exchanger; and a control system. In one embodiment, the evaporator receives refrigerant from the vapor compression circuit and provides a cooled stream of air to the space. The air-reheat heat exchanger is positioned to receive the cooled stream of air. In one embodiment, the vapor compression circuit, the evaporator, and the air-reheat heat exchanger are operable in combination to provide a plurality of modes of operation. In a preferred embodiment, the control system is configured to compute a Sensible cooling-to-Total cooling (S/T) process ratio and to control an operation of at least one of the vapor compression circuit, the evaporator, and the air-reheat heat exchanger. A method of manufacturing the air conditioning system is also provided.

18 Claims, 4 Drawing Sheets

ENHANCED DEHUMIDIFICATION CONTROL WITH VARIABLE CONDENSER REHEAT

TECHNICAL FIELD OF THE INVENTION

The present invention is directed, in general, to air conditioning and, more particularly, to a control system for air conditioning systems employing dehumidification and reheat.

BACKGROUND OF THE INVENTION

Air conditioning systems with a re-heating system for active humidity control can overcool the air provided to the conditioned space while performing active dehumidification. This occurs because the re-heat coil is not sized to provide neutral supply air temperature. For example, condenser reheat systems, like the Lennox Humiditrol® EDA, still have a Sensible cooling-to-Total cooling ratio (S/T) of about 0.25 so that some sensible cooling is occurring while dehumidification is being required by the humidistat setting.

A typical control scheme uses "cooling priority" first to satisfy the cooling requirement from the thermostat, and then, if there is excess humidity detected by the humidity sensor, the vapor compression circuit and evaporator continue to cool the air so that the excess humidity can be removed. Since, under most conditions, there is a positive S/T ratio, the space continues to be cooled during this continued dehumidification mode. This results in overcooling of the air and conditioned space. Some thermostats even employ an "overcooling limit" to stop the dehumidification mode from lowering the conditioned air too far below the temperature setpoint even if the desired relative humidity has not been met. The fact that enhanced dehumidification is only enabled after the temperature setpoint has been achieved means that more than the minimum amount of energy is being used to provide the space with conditioned air.

Accordingly, what is needed in the art is an air conditioning system that avoids the wasted energy of overcooling the air in order to achieve the desired relative humidity.

SUMMARY OF THE INVENTION

To address the above-discussed deficiencies of the prior art, the present invention provides, in one aspect, an air conditioning system comprising an air mover for circulating air to a space; a vapor compression circuit including a compressor, a condenser, and an expansion device; an evaporator; an air-reheat heat exchanger; and a control system. In a preferred embodiment, the evaporator receives refrigerant from the vapor compression circuit and is adapted to provide a cooled stream of air to the space. In a further aspect, the air-reheat heat exchanger is positioned to receive the cooled stream of air. In one embodiment, the vapor compression circuit, the evaporator, and the air-reheat heat exchanger are operable in combination to provide a plurality of modes of operation. In a preferred embodiment, the control system is configured to compute a Sensible cooling-to-Total cooling (S/T) process ratio and to control an operation of at least one of the vapor compression circuit, the evaporator, and the air-reheat heat exchanger. A method of manufacturing the air conditioning system is also provided.

The foregoing has outlined preferred and alternative features of the present invention so that those skilled in the pertinent art may better understand the detailed description of the invention that follows. Additional features of the invention will be described hereinafter that form the subject of the claims of the invention. Those skilled in the pertinent art should appreciate that they can readily use the disclosed conception and specific embodiment as a basis for designing or modifying other structures for carrying out the same purposes of the present invention. Those skilled in the pertinent art should also realize that such equivalent constructions do not depart from the spirit and scope of the invention.

BRIEF DESCRIPTION OF THE DRAWINGS

For a more complete understanding of the invention, reference is now made to the following descriptions taken in conjunction with the accompanying drawing, in which.

DETAILED DESCRIPTION

Figure 1:
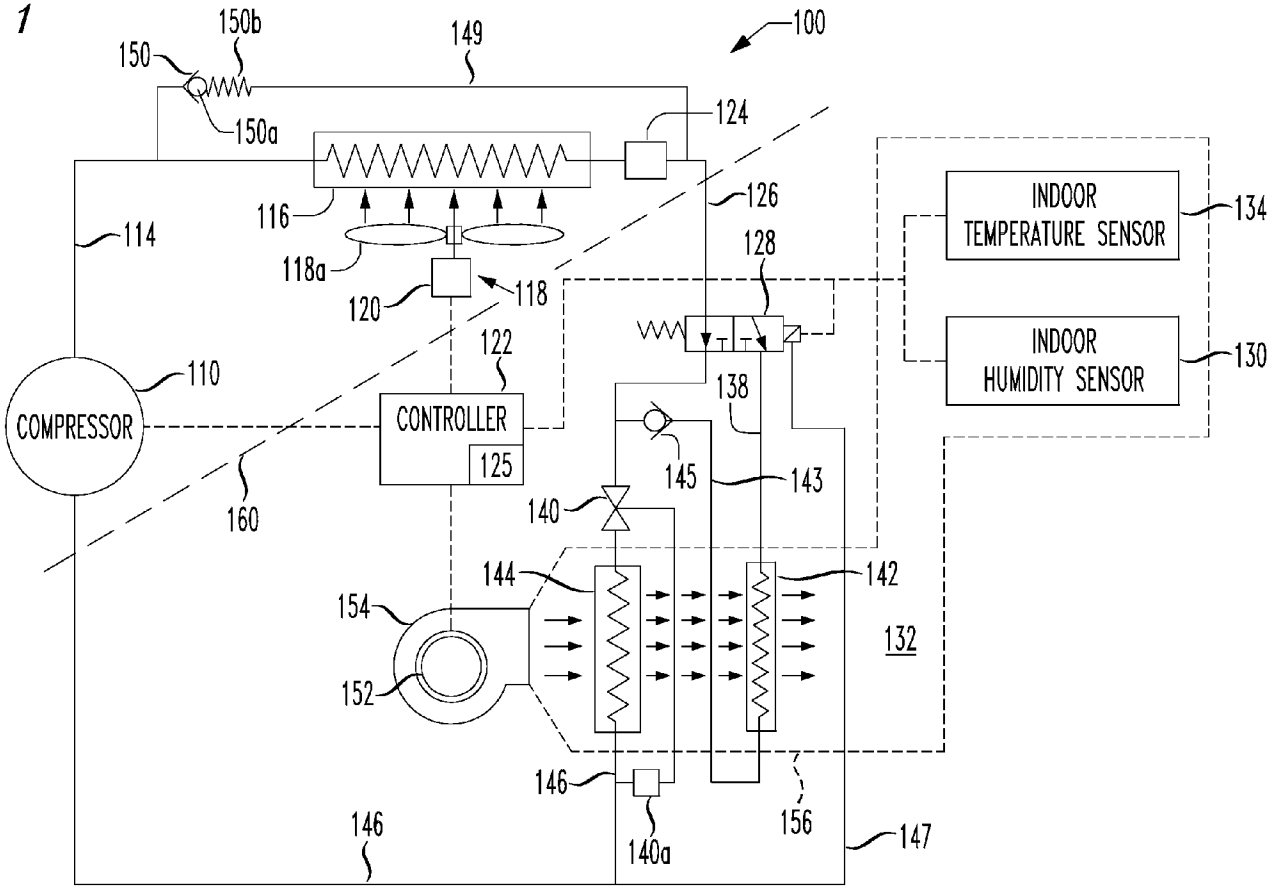
FIG. 1 illustrates a schematic diagram of an air conditioning system constructed according to the principles of the present invention.

Referring initially to FIG. 1, illustrated is a schematic diagram of an air conditioning system 100 constructed according to the principles of the present invention. The air conditioning system 100 comprises a conventional electric motor-driven compressor 110 connected via a conduit 114 to a refrigerant fluid, primary condenser heat exchanger 116 disposed typically outdoors. The heat exchange between fluid flowing through the condenser heat exchanger 116 and ambient outside air is controlled by a fan 118 having a plurality of fixed pitch blades 118*a* and which is driven by a variable-speed electric motor 120. The variable-speed electric motor 120 may be an electrically-commutated type operating on variable frequency and voltage AC electric power as supplied to the motor 120 via a suitable controller 122. Fan 118 propels a heat exchange medium, such as ambient "outdoor" air through condenser heat exchanger 116 in a known manner. Condenser heat exchanger 116 may also operate with other forms of heat exchange medium at controlled flow rates thereof. Control of heat exchange medium flowing over condenser heat exchanger 116 may take other forms such as a constant-speed variable pitch fan, air flow control louvers, or control of a variable flow of a liquid heat exchange medium. Condenser heat exchanger 116 is also operably connected to a conventional refrigerant fluid filter and dryer 124 disposed in a conduit 126 for conducting condensed refrigerant fluid to a power-operated or so called motor-controlled valve 128. Valve 128 may be controlled by a solenoid, for example, and may be of a type commercially available. The solenoid for the valve 128 is also adapted to be controlled by a suitable humidity sensor 130 through controller 122 disposed in a space 132 to be conditioned by the system 100. In a preferred embodiment, the humidity sensor 130 may be a conventional humidistat with capability to receive input of a desired relative humidity called a relative humidity setpoint $RH_{sp}$. The humidity sensor 130 is also operably connected to controller 122. A temperature sensor 134, disposed within the conditioned space 132, is also operably connected to the controller 122. In a preferred embodiment, the temperature sensor 134 may be a conventional thermostat with capability to receive input of a desired temperature called a temperature setpoint $T_{sp}$. Controlled and conditioned space 132 is represented only schematically in the drawing figures and a return air path from space 132 or another source of air to be conditioned is omitted in the interest of conciseness.

Conduit 126 is connected by way of valve 128 to further refrigerant conducting conduits 136 and 138 to a conventional refrigerant fluid expansion device 140 and to an air-reheat heat exchanger 142, respectively. The compressor 110, condenser 116, and expansion device 140 together may be properly termed a vapor compression circuit. The vapor compression circuit is sized so as to enable conditioning of the air returned to space 132 at the desired relative humidity $RH_{sp}$. Conduit 136 is operable to deliver refrigerant fluid to a heat exchanger or so called evaporator 144 by way of the expansion device 140. Expansion device 140 is coupled to a remote temperature sensor 140*a* which is adapted to sense the temperature of refrigerant fluid leaving the heat exchanger 144 by way of a conduit 146. Conduit 146 is commonly known as the suction line leading to compressor 110 whereby refrigerant fluid in vapor form is compressed and recirculated through the system 100 by way of condenser heat exchanger 116. A suitable valve operator vent conduit 147 is connected between valve 128 and conduit 146. Heat exchangers 116, 142 and 144 may be conventional multiple fin and tube type devices, for example.

Air-reheat heat exchanger, also known as an air-reheat condenser 142 is adapted to receive refrigerant fluid from condenser heat exchanger 116 through conduit 138 and discharge such fluid through a conduit 143 and a check valve 145 to conduit 136 upstream of expansion device 140. The air-reheat condenser 142 is capable of and may be used to raise the temperature of air returned to space 132 to the desired temperature $T_{sp}$. Under certain operating conditions refrigerant fluid may also be advantageously permitted to bypass the condenser heat exchanger 116 through a conduit 149 and a pressure relief valve 150. Pressure relief valve 150 includes a closure member 150*a* which is biased into a valve-closed position by resilient means, such as a coil spring 150*b*. In response to a predetermined pressure, or range of pressures, acting on the closure member 150*a*, the pressure relief valve 150 operates to bypass fluid flowing through conduit 114 around the condenser heat exchanger 116 directly to conduit 126 downstream of the filter/dryer 124, as shown, and to the air reheat heat exchanger 142.

In the operation of the air conditioning system 100, controller 122 operates to control a drive motor 152 for a supply air blower or fan 154 of a conventional type. Ambient outdoor air, or air being circulated as return air from space 132, is propelled by motor driven blower 154 through a suitable duct 156 wherein the heat exchangers 142 and 144 are disposed. Specifically, air-reheat heat exchanger 142 is downstream of heat exchanger 144. One who is skilled in the art will recognize that the system 100 includes elements of a conventional vapor compression air conditioning system wherein compressor 110 compresses a suitable refrigerant fluid which is condensed in condenser heat exchanger 116 and is conducted to heat exchanger or evaporator 144 through expansion device 140 wherein the condensed refrigerant fluid is expanded and absorbs heat from the air flowing through the duct 156 to provide cooled air to space 132. This operation is controlled by controller 122 using data demanded by temperature sensor 134 and humidity sensor 130. Controller 122 operates to control fan motor 152 as well as motor driven compressor 110 and the variable speed fan motor 120 which controls the amount of cooling air flowing over condenser heat exchanger 116. Controller 122 comprises a microprocessor 125 for management of an algorithm to be described below.

If the relative humidity requirements of the space 132 are not being met by operation of the system 100 wherein all refrigerant fluid is being directed from conduit 126 directly to conduit 136, control valve 128 will be actuated to force refrigerant fluid to and through air-reheat heat exchanger 142 giving up heat to air flowing through the duct 156 into the space 132 thereby raising the temperature of such air and reducing the rate of sensible cooling occurring. Since refrigerant fluid condensed and highly subcooled in the air-reheat heat exchanger/condenser 142 then flows via conduit 143 to expansion device 140 and evaporator 144, substantial cooling effect is imparted to air being discharged by blower 154 and flowing through evaporator 144 to thereby condense moisture in the air flowing through duct 156. Blower 154 may also be termed an air mover. Accordingly, air propelled by blower 154 is first cooled by heat exchanger 144 to condense moisture therein and is then reheated by air-reheat heat exchanger 142 to meet the temperature and humidity requirements of the space 132. If the humidity requirements of space 132 are not being met by the aforementioned operation of system 100, the controller 122 reduces the speed of the fan motor 120 and fan 118, thereby reducing the heat exchange taking place by air flow through the condenser heat exchanger 116. Fan motor 120 may be controlled to continuously vary the speed of fan 118 or motor output speed may be varied in discrete steps. In this way a greater heat rejection load is placed on air-reheat heat exchanger 142, progressively, thus raising the temperature of the air flowing into space 132 to further reduce the relative humidity. Commonly, the blower 154 is also reduced in speed during enhanced dehumidification operation.

In those circumstances where the reduced exchange of heat at the condenser heat exchanger 116 occurs, the configuration of the condenser heat exchanger 116 may be such as to impose a relatively large fluid pressure drop thereacross for refrigerant fluid flowing therethrough, particularly if a substantial amount of such fluid is remaining in gaseous form. However, since a greater amount of condensation is occurring in air-reheat heat exchanger 142, as the fluid condensing load is shifted from heat exchanger 116 to air-reheat heat exchanger 142, refrigerant fluid in gaseous form may bypass heat exchanger 116 by way of pressure relief valve 150 and conduit 149 without degrading the performance of the system 100.

Another advantage of the system 100 is that only two refrigerant fluid conduits are required to extend between the indoor portion of the system 100, as indicated by dashed line 160, wherein the indoor portion is that generally below the line as shown in the figure. The outdoor portion of system 100 typically includes the compressor 110 and the condenser heat exchanger 116, as well as the condenser fan and motor 118, 120. In other words only conduits 126 and 146 and control wiring for compressor 110 and motor 120 are required to extend between the indoor and outdoor parts of the system as diagrammatically separated by dashed line 160. This improved arrangement provides for retrofitting of certain air conditioning systems, since the outdoor portion of an existing system may be unaffected by replacing the original indoor portion of the existing system with the indoor portion of system 100.

At this point, it is desirable to define terms to be used later in the description. Relative humidity setpoint $RH_{sp}$ and temperature setpoint $T_{sp}$ have been previously described as the commanded relative humidity and temperature for the space 132. The humidistat 130 senses and reports to the controller 122 the current relative humidity $RH_{id}$ of the space 132. In like manner, the thermostat 134 senses and reports to the controller 122 the current indoor temperature $T_{id}$ of the space 132. The absolute humidity ratio for the setpoint $\omega_{sp}$ conditions is defined as the pounds of water ($H_2O$) per pound of air for the relative humidity setpoint $RH_{sp}$ and temperature setpoint $T_{sp}$ conditions. The absolute indoor humidity ratio $\omega_{id}$ is defined as the pounds of water per pound of air. To calculate the absolute humidity ratio for the setpoint $\omega_{sp}$ conditions, empirical equation 1 is used:

$$\omega_{sp} = \left[\left(\frac{RH_{sp}}{0.4}\right) * (7.875 + 0.00010438 * T_{sp}^3) + (0.0005 * (T_{sp} - 50)^{2.2})\right] * \left[\frac{1}{7000}\right] \quad \text{Eq. 1}$$

To calculate the absolute indoor humidity ratio $\omega_{id}$, empirical equation 2 is used:

$$\omega_{id} = \left[\left(\frac{RH_{id}}{0.4}\right) * (7.875 + 0.00010438 * T_{id}^3) + (0.0005 * (Tid - 50)^{2.2})\right] * \left[\frac{1}{7000}\right] \quad \text{Eq. 2}$$

To calculate the process latent load in Btu/lb of air:

$$L = 1050 * (\omega_{id} - \omega_{sp}) \quad \text{Eq. 3}$$

To calculate the process sensible load in Btu/lb of air:

$$S = 0.24 * (T_{id} - T_{sp}) \quad \text{Eq. 4}$$

To calculate the Process Sensible to Total cooling ratio (S/T):

$$\frac{S}{T} = \left(\frac{S}{S + L}\right) \quad \text{Eq. 5}$$

Figure 2:
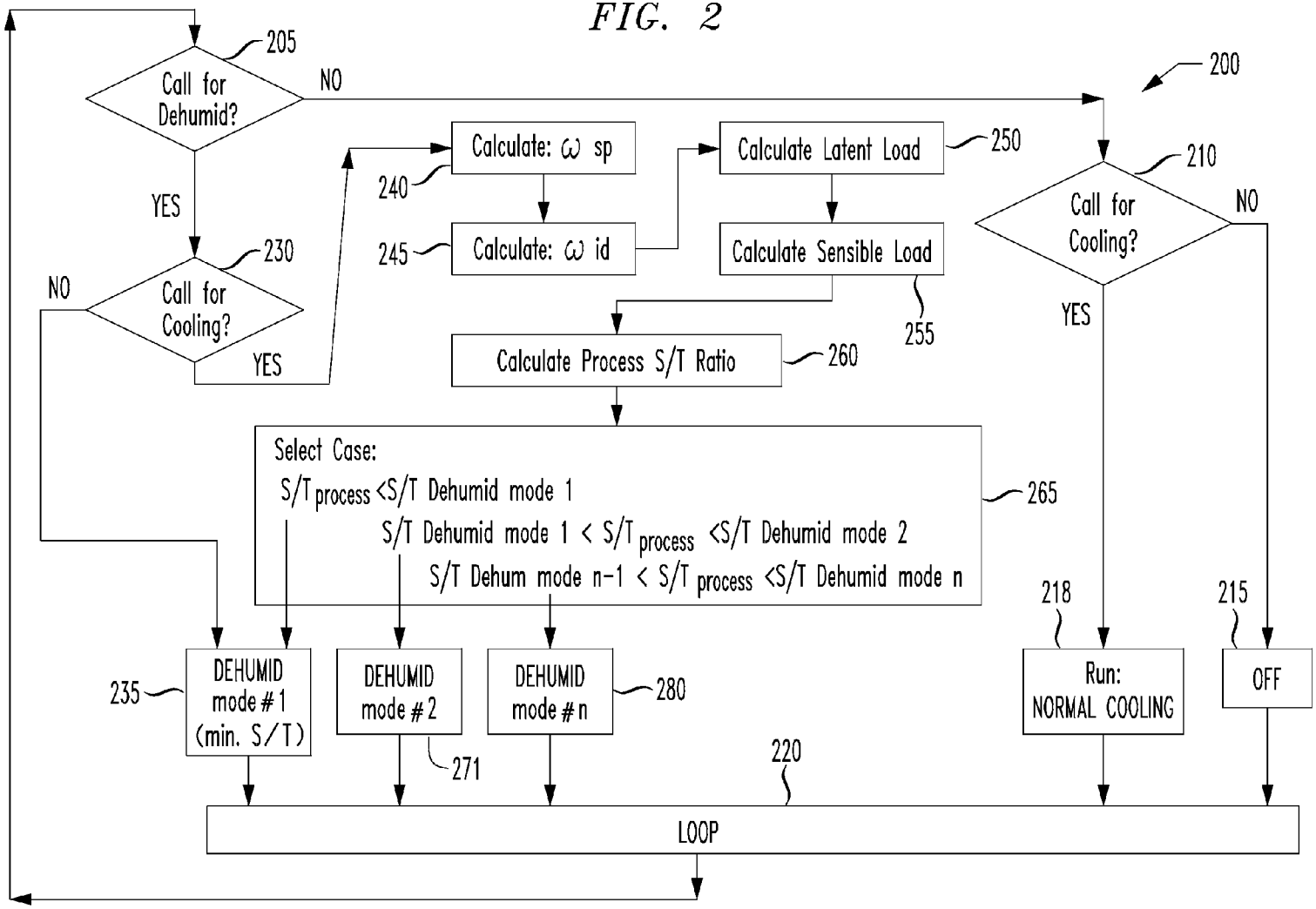
FIG. 2 illustrates a flow diagram for an enhanced dehumidification control algorithm assembled in accordance with the principles of the present invention as implemented in the controller of FIG. 1.

Referring now to FIG. 2, illustrated is a flow diagram for an enhanced dehumidification control algorithm 200 assembled in accordance with the principles of the present invention as implemented in the controller 122 of FIG. 1. Commencing at Step 205, the microprocessor 125 within the controller 122 determines if the humidistat 130 is calling for dehumidification. If the answer is NO, then the algorithm proceeds to Step 210 wherein the microprocessor 125 determines if the thermostat 134 is calling for cooling. If the answer is NO, then the algorithm proceeds to Step 215 confirming that both cooling and dehumidification are OFF. The microprocessor 125 then continues to loop 220 and returns to Step 205 wherein the algorithm 200 continues.

Returning to Step 210, if the microprocessor 125 determines that the thermostat 134 is calling for cooling, i.e., the answer is YES, the algorithm 200 proceeds to Step 218, and normal cooling is commanded by the controller 122. The microprocessor 125 then continues to loop 220 and returns to Step 205 wherein the algorithm 200 continues. This portion of the algorithm 200 as described constitutes a normal cooling cycle as one who is of skill in the art would expect, except that the algorithm 200 is arranged for dehumidification priority as compared to conventional cooling priority.

Continuing from Step 205, if the microprocessor 125 determines that the humidistat 130 is calling for dehumidification, i.e., the answer is YES, the algorithm 200 proceeds to Step 230. At Step 230, the microprocessor 125 determines if the thermostat 134 is calling for cooling. If the answer is NO, the algorithm 200 proceeds to Step 235, and dehumidification at the minimum S/T is commanded by the controller 122. If the answer is YES, the algorithm 200 proceeds to Step 240.

At Step 240, the microprocessor 125 calculates $\omega_{sp}$ from the setpoint temperature $T_{sp}$ and setpoint relative humidity $RH_{sp}$ in accordance with Equation 1. The algorithm 200 proceeds to Step 245 where $\omega_{id}$ is calculated from current indoor temperature $T_{id}$ and current indoor relative humidity $RH_{id}$ in accordance with Equation 2. The algorithm 200 then proceeds to Step 250 where latent load L is calculated from $\omega_{id}$ and $\omega_{sp}$ in accordance with Equation 3. At Step 255 sensible load S is calculated in accordance with Equation 4 from $T_{id}$ and $T_{sp}$. At Step 260, the Process S/T Ratio is calculated from the Sensible load S and the Total load T=L+S in accordance with Equation 5.

Within the microprocessor 125, there are resident dehumidification modes 1 through n corresponding to n configurations of the various variable elements of the system 100. In one embodiment, the variable elements may include, but are not limited to, outdoor fan speed, air-reheat condenser 142 active or inactive, indoor fan speed, etc. Associated with each of the dehumidification modes 1 through n is a pre-calculated S/T ratio. The microprocessor uses these pre-calculated S/T ratios, i.e., $S/T_1$, $S/T_2$, . . . $S/T_{n-1}$, $S/T_n$, for comparison with the Process S/T Ratio. At Step 265, commencing with the first dehumidification mode n=1, i.e., $S/T_1$, the Process S/T ratio is compared to the pre-calculated S/T ratios until a condition is found wherein $S/T_{process} < S/T_m$. For example, if $S/T_1 < S/T_{process} < S/T_2$, then the microprocessor 125 selects Mode 2 and adjusts settings of the various variable elements to correspond to the corresponding stored configuration for Mode 2.

Figure 3:
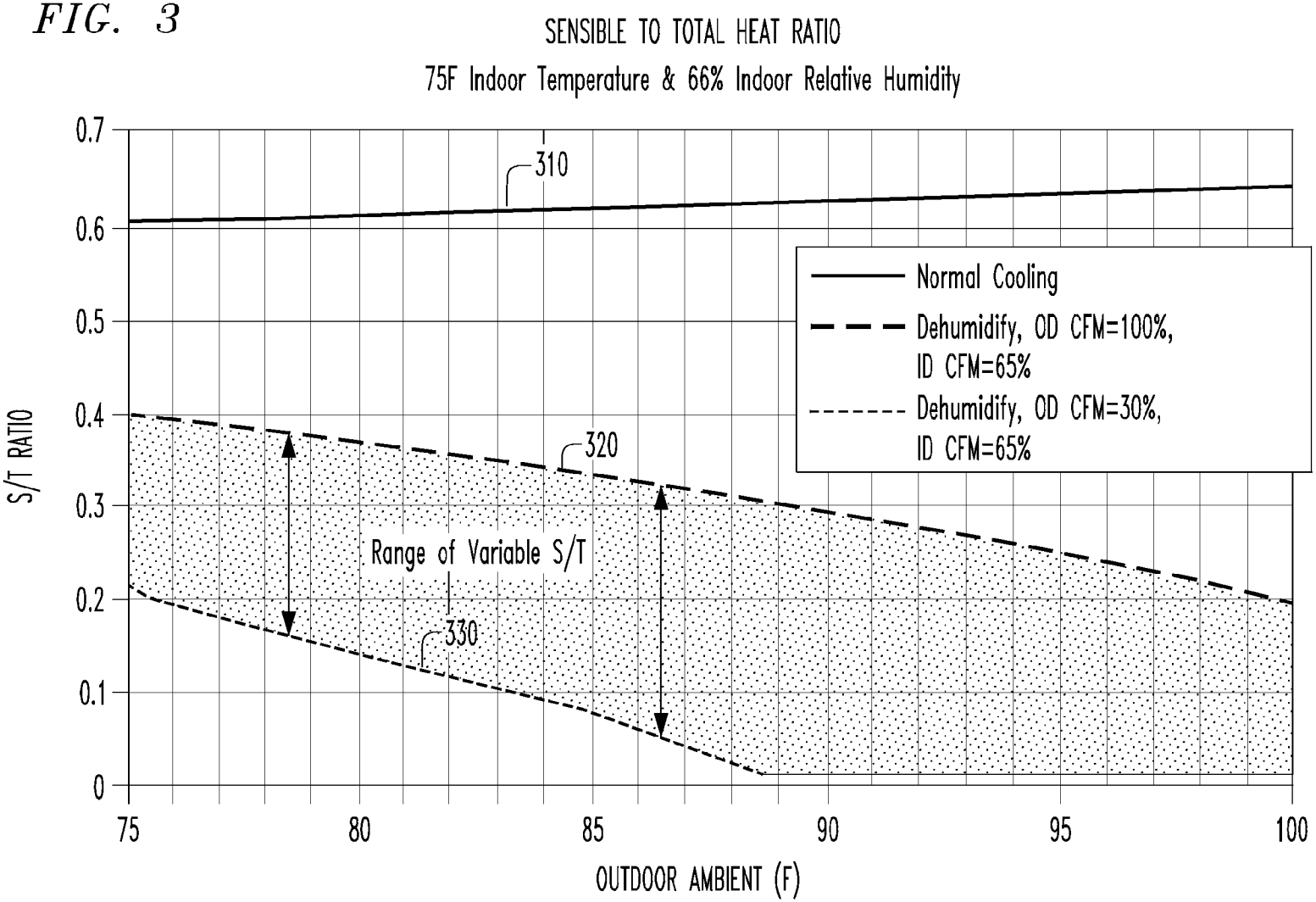
FIG. 3 illustrates a performance chart of three modes of operation of the air conditioning system of FIG. 1 with a 75° F. indoor dry bulb temperature and a 66% indoor relative humidity.

Referring now to FIG. 3, illustrated is a performance chart of three modes of operation of the air conditioning system 100 of FIG. 1 with a 75° F. indoor dry bulb temperature and a 66% indoor relative humidity. A normal cooling without reheat performance of the system 100 is shown in a first graphical plot 310. A second graphical plot 320 shows a system configuration of dehumidification (air-reheat condenser 142 active) with the outdoor fan operating at 100 percent and the indoor fan operating at 65 percent. A third graphical plot 330 shows a configuration of dehumidification (air-reheat condenser 142 active) with the outdoor fan operating at 30 percent and the indoor fan operating at 65 percent. With an abscissa scale of outdoor ambient temperature and an ordinate of S/T ratio, the performance of the system 100 will follow the appropriate graph for the selected configuration. As shown in the first graphical plot 310, the S/T ratio for the normal cooling without reheat stays relatively flat at about 0.61 to about 0.63 over the temperature range from about 75° F. to about 104° F. The S/T ratio for the second configuration is shown to vary substantially linearly from about 0.4 at 75° F. to about 0.25 at about 95° F. The third configuration S/T ratio is shown to vary substantially linearly from about 0.2 at 75° F. to about 0.08 at about 85° F.

An example will be helpful in understanding the algorithm 200. With current indoor temperature at 77° F. and indoor relative humidity at 49%, it is desired to find a process line and system configuration to avoid overcooling and to more directly condition the indoor air to 75° F. and 50% relative humidity. Entering the algorithm 200 of FIG. 2 at Step 205, we conclude that both dehumidification and cooling are required, advancing to Step 240 calculate $\omega_{sp}$. From Equation 1, with $T_{sp}$ at 75° F. and $RH_{sp}$ at 50% (0.50), $\omega_{sp}$ evaluates to 0.0094. At Step 245 with $T_{id}$ at 77° F. and $RH_{id}$ at 49%

(0.49), $\omega_{id}$ evaluates to 0.0098 from Equation 2. At Step 250 with $\omega_{sp}$ and $\omega_{id}$ as just calculated, latent load L evaluates to 0.487 BTU/lb of air from Equation 3. At Step 255 with $T_{id}$ and $T_{SP}$ as above, sensible load S evaluates to 0.48 BTU/lb of air from Equation 4. At Step 260, the $S/T_{process}$ ratio evaluates to 0.497 from Equation 5. At Step 265, the $S/T_{process}$ ratio of 0.497 is compared to the known S/T ratios for the three configurations of the system 100. Within Step 265, the $S/T_{process}$ ratio of 0.497 is compared to the $S/T_{Mode\ 1}$ ratio of about 0.18. The $S/T_{process}$ ratio is greater than the $S/T_{Mode\ 1}$ ratio, however, it is not yet known if the $S/T_{process}$ ratio is greater than the $S/T_{Mode\ 2}$ ratio. Upon comparing, the $S/T_{process}$ ratio of 0.497 is found to be greater than the $S/T_{Mode\ 2}$ ratio of about 0.38. Again however, it is not yet known if the $S/T_{process}$ ratio is greater than the $S/T_{Mode\ 3}$ ratio. Upon comparing, the $S/T_{process}$ ratio of 0.497 is found to be less than the $S/T_{Mode\ 3}$ ratio of about 0.60. Having satisfied the condition that $S/T_{Mode\ n}<S/T_{process}<S/T_{Mode\ n+1}$, the algorithm 200 selects dehumidification mode 2 as requiring the least energy to achieve the desired temperature and relative humidity. Dehumidification mode 2 corresponds to a configuration of air-reheat condenser 142 active, outdoor fan speed at 100%, and indoor fan speed at 65%.

Figure 4:
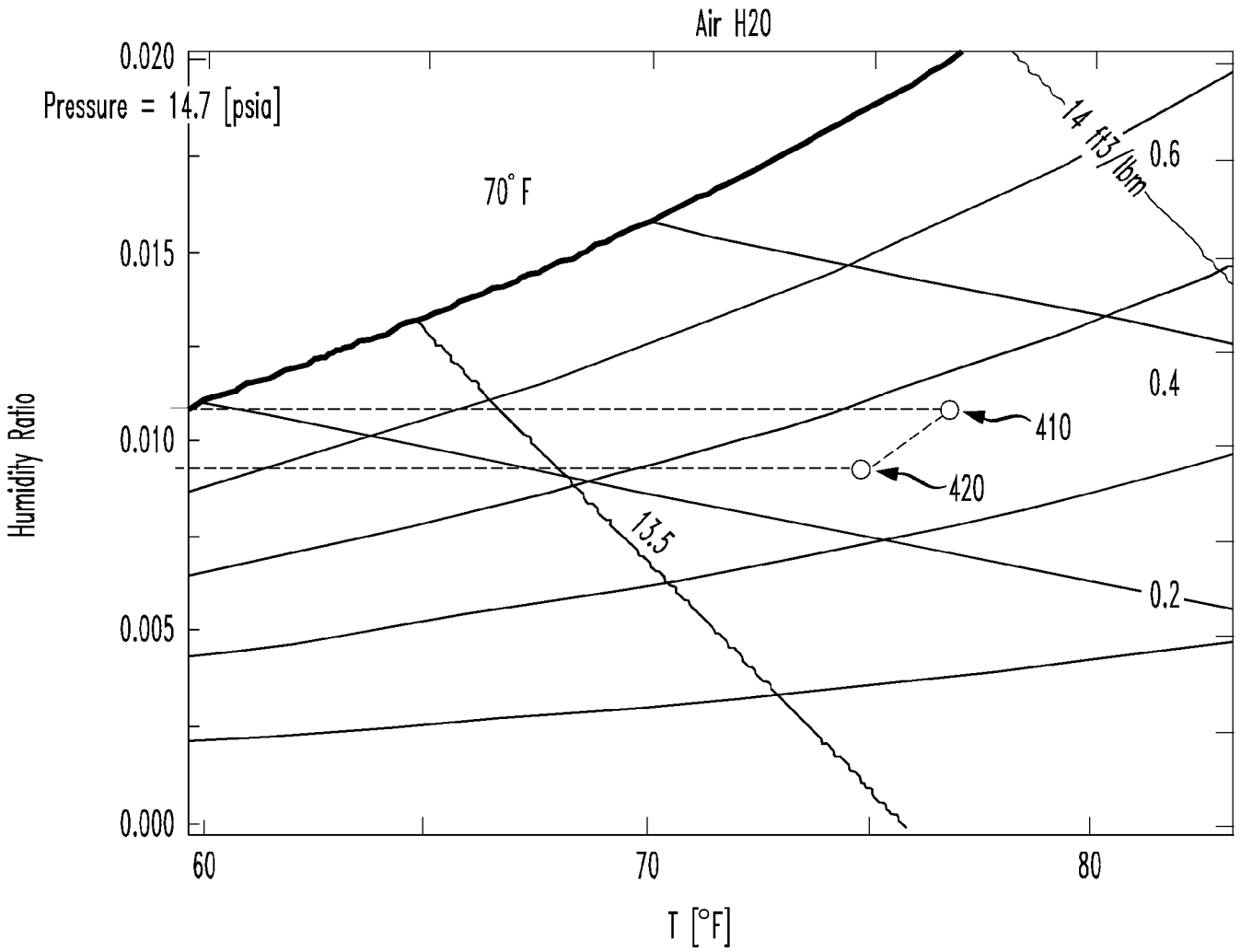
FIG. 4 illustrates a psychrometric chart covering normal indoor temperature and humidity ranges.

Referring now to FIG. 4, illustrated is a psychrometric chart 400 covering normal indoor temperature and humidity ranges. Normal indoor temperature ranges from about 68° F. to about 82° F. and is indicated along the abscissa. The ordinate covers an absolute humidity ratio ranging from about 0.0 to about 0.020. Current temperature and absolute humidity ratio is represented as a first point 410 at 77° F. and about 0.011 humidity ratio. The desired temperature, 75° F. and about 0.0093 absolute humidity ratio is represented as a second point 420. The path from the first point 410 to the second point 420 represents the desired process path. Operating the system 100 in dehumidification mode 2 with air-reheat condenser 142 active, outdoor fan speed at 100%, and indoor fan speed at 65% will approximate the desired process path.

Thus, an air conditioning system has been described that employs computation of a Process Sensible to Total Cooling ratio and the selection of the air conditioning system configuration having a reasonable close approximation to the Process Sensible to Total Cooling ratio. Of course, other parameters of the air conditioning system may also be included, thereby possibly more closely approaching the desired Process Sensible to Total Cooling ratio.

The control algorithm has a loop 220 arrangement. The status of the Process Sensible to Total Cooling ratio is repeatedly evaluated over time and adjustments in air conditioner operation are made in response to changes in the sensible and latent loads.

Although the present invention has been described in detail, those skilled in the pertinent art should understand that they can make various changes, substitutions and alterations herein without departing from the spirit and scope of the invention in its broadest form.

What is claimed is:

1. An air conditioning system, comprising:

an air mover for circulating air to a space;

a vapor compression circuit including a compressor, a condenser, and an expansion device;

an evaporator for receiving refrigerant from said vapor compression circuit and adapted to provide a cooled stream of air to said space;

an air-reheat heat exchanger, configured to receive said refrigerant from said condenser, positioned to receive said cooled stream of air; wherein said vapor compression circuit, said evaporator, and said air-reheat heat exchanger are operable in combination to provide a plurality of modes of operation; and a control system configured to compute a Sensible cooling-to-Total cooling (S/T) process ratio and wherein said S/T process ratio is compared to one or more S/T dehumidification modes associated with predetermined settings of said vapor compression circuit, said evaporator, and said air-reheat heat exchanger to select a one of said S/T dehumidification modes and thereby to control said predetermined settings of said vapor compression circuit, said evaporator, and said air-reheat heat exchanger associated with said selected one of said S/T dehumidification modes.

2. The air conditioning system as recited in claim 1 wherein said control system is further configured to:

receive a first input of a desired temperature and a desired humidity of said space; and compute a desired absolute humidity ratio from said first input.

3. The air conditioning system as recited in claim 2 wherein said vapor compression circuit is sufficient to provide said cooled stream of air with an actual humidity corresponding to said desired humidity.

4. The air conditioning system as recited in claim 2 wherein said air-reheat heat exchanger is sufficient to provide said cooled stream of air with an actual temperature corresponding to said desired temperature.

5. The air conditioning system as recited in claim 2 wherein said control system is further configured to:

receive a second input of a current temperature and a current humidity conditions of said space; and compute an indoor absolute humidity ratio from said second input.

6. The air conditioning system as recited in claim 5 wherein said control system is further configured to compute said S/T process ratio from said desired absolute humidity ratio and said indoor absolute humidity ratio.

7. The air conditioning system as recited in claim 1 wherein each of said plurality of modes of operation comprises a configuration of:

said air mover;

said evaporator; and said air-reheat heat exchanger, in combination.

8. The air conditioning system as recited in claim 2 wherein said control system is configured to prioritize said desired humidity over said desired temperature.

9. The air conditioning system as recited in claim 1 wherein said air-reheat heat exchanger is communicated with at least one of a liquid discharged from said condenser and a gas discharged from said compressor for reheating said cooled stream of air to a desired temperature for said space.

10. A method of manufacturing an air conditioning system, comprising:

providing an air mover for circulating air to a space;

providing a vapor compression circuit including a compressor, a condenser, and an expansion device;

providing an evaporator for receiving refrigerant from said vapor compression circuit and adapted to provide a cooled stream of air to said space;

positioning an air-reheat heat exchanger to receive said cooled stream of air, wherein said air-reheat exchanger is configured to receive said refrigerant from said condenser;

configuring said vapor compression circuit, said evaporator, and said air-reheat heat exchanger to be operable in combination to provide a plurality of modes of operation; and configuring a control system to compute a Sensible cooling-to-Total cooling (S/T) process ratio wherein said S/T process ratio is compared to one or more S/T dehumidification modes associated with predetermined settings of said vapor compression circuit, said evaporator, and said air-reheat heat exchanger to select a one of said S/T dehumidification modes and thereby to control said predetermined settings of said vapor compression circuit, said evaporator, and said air-reheat heat exchanger associated with said selected one of said S/T dehumidification modes.

11. The method as recited in claim 10 wherein configuring a control system further comprises configuring a control system to:

receive a first input of a desired temperature and a desired humidity of said space; and compute a desired absolute humidity ratio from said first input.

12. The method as recited in claim 11 wherein providing a vapor compression circuit includes providing a vapor compression circuit sufficient to provide said cooled stream of air with an actual humidity corresponding to said desired humidity.

13. The method as recited in claim 11 wherein providing an air-reheat heat exchanger includes providing an air-reheat heat exchanger sufficient to provide said cooled stream of air with an actual temperature corresponding to said desired temperature.

14. The method as recited in claim 11 wherein configuring a control system further comprises configuring a control system to:

receive a second input of a current temperature and a current humidity conditions of said space; and compute an indoor absolute humidity ratio from said second input.

15. The method as recited in claim 14 wherein configuring a control system further comprises configuring a control system to compute said process ratio from said desired absolute humidity ratio and said indoor absolute humidity ratio.

16. The method as recited in claim 10 wherein configuring said vapor compression circuit, said evaporator, and said air-reheat heat exchanger includes configuring said vapor compression circuit, said evaporator, and said air-reheat heat exchanger wherein each of said plurality of modes of operation comprises a configuration of:

said air mover;

said evaporator; and said air-reheat heat exchanger, in combination.

17. The method as recited in claim 10 further comprising configuring said air-reheat heat exchanger to communicate liquid discharged from said condenser for reheating said cooled stream of air to a desired temperature for said space.

18. The method as recited in claim 10 further comprising configuring said air-reheat heat exchanger to communicate gas discharged from said compressor for reheating said cooled stream of air to a desired temperature for said space.

* * * * *